United States Patent [19]

Hachitani et al.

[11] 4,425,889

[45] Jan. 17, 1984

[54] ELECTRIC GOVERNOR FOR INTERNAL COMBUSTION ENGINE

[75] Inventors: Shuji Hachitani, Anjo; Yasushi Tanaka; Haruhiko Ogiso, both of Kariya; Tetsuya Nakamura, Chiryu, all of Japan

[73] Assignee: Nippondenso Co., Ltd., Kariya, Japan

[21] Appl. No.: 366,085

[22] Filed: Apr. 6, 1982

[30] Foreign Application Priority Data

Apr. 10, 1981 [JP] Japan ..... 56-54508

[51] Int. Cl.[3] ..... F02M 59/00

[52] U.S. Cl. ..... 123/357; 123/479

[58] Field of Search ..... 123/357, 358, 359, 479

[56] References Cited

U.S. PATENT DOCUMENTS

| | | | |
|---|---|---|---|
| 3,682,152 | 8/1972 | Muller-Berner | 123/357 |
| 3,777,174 | 12/1973 | Butscher et al. | 123/357 |
| 3,906,207 | 9/1975 | Rivere et al. | 123/479 |
| 3,939,738 | 2/1976 | Adey et al. | 123/357 |
| 4,212,279 | 7/1980 | Ohtani | 123/357 |
| 4,219,000 | 8/1980 | Locher et al. | 123/357 |

*Primary Examiner*—Ira S. Lazarus
*Assistant Examiner*—Magdalen Moy
*Attorney, Agent, or Firm*—Cushman, Darby & Cushman

[57] ABSTRACT

An electric governor for electrically controlling the fuel injection amount of a fuel injection pump has two engine speed detectors for producing engine speed indication signals. One of the two detectors produces the signal by using a gear coupled to the pump drive shaft and electromagnetic pickup, and the other of the detectors produces the signal by an output signal of an alternator. Normally the engine speed indication signal is selected from the electromagnetic pickup and used for control of the fuel injection amount, and the output signal of the alternator is used when the electromagnetic pickup generates does not generate the normal output signal.

6 Claims, 27 Drawing Figures

ELECTRIC GOVERNOR FOR INTERNAL COMBUSTION ENGINE

BACKGROUND OF THE INVENTION

The present invention relates to an electric governor for a fuel injection pump of an internal combustion engine or a diesel engine in particular.

In a conventional electric governor, a sensor of an electromagnetic pickup including a permanent magnet wound with a coil for detecting the engine speed is generally provided in opposition to a ring gear of the engine or a gear made of a magnetic member rotating at a speed proportional to the engine speed on the governor. Each time the tip of the gear of the magnetic material passes the sensor of the electromagnetic pickup, the magnetic fluxes change and an AC voltage of a frequency proportional to the engine speed is induced in the coil of the electromagnetic pickup, thus making it possible to produce a signal changing in accordance with the engine speed from the electromagnetic pickup.

The conventional electric governors have only one electromagnetic pickup for reasons of cost and mountability, and in the case where normal detection of the engine speed becomes impossible due to such troubles as the breakage of the coil of the electromagnetic pickup, the breakage of the wire harness connecting the electromagnetic pickup and an electric control circuit for determining the injection amount or ill contact of the connector, the engine is stopped by a safety mechanism including the electric control circuit.

In the event that the electromagnetic pickup fails to produce a signal changing with the engine speed for some faults, therefore, the conventional electric governor is such that the engine is stopped by the electric control circuit, thus making impossible the powered running of the automobile to a passing place on a freeway or in a wide open area.

SUMMARY OF THE INVENTION

The present invention has been developed in view of the problems of the conventional electric governors, and is intended to provide an electric governor comprising an electric control circuit for determining a target fuel injection amount in response to an input signal changing with the engine speed or a signal associated with other engine operating conditions, and an actuator of electromagnetic or fluid pressure type controlled by the electric control circuit for driving and holding a fuel injection amount regulator member of the fuel injection pump at a position corresponding to a target fuel injection amount, the electric governor further comprising a plurality of engine speed detector means for producing a signal changing with the engine speed, means for applying a plurality of signals from the plurality of the engine speed detector means to the electric control circuit, the electric control circuit selecting a signal from normal one of the plurality of engine speed detector means, which signal is used for detecting the engine speed which in turn is used for determining a target fuel injection amount thereby to drive the actuator of electromagnetic type or fluid pressure type, so that in the event that the engine speed detector means designated for detecting the engine speed fails to produce a normal signal for some troubles, the engine speed is detected by a signal from another engine speed detector means thereby to permit the continued operation of the engine.

DESCRIPTION OF THE PREFERRED EMBODIMENT

Figure 1:
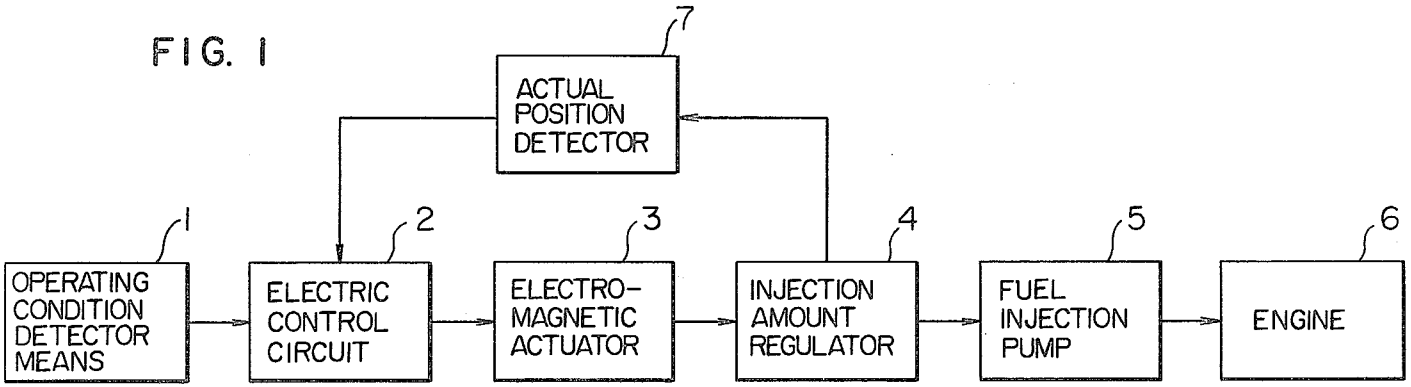
FIG. 1 is a diagram schematically showing the configuration of an embodiment of the present invention.

The present invention will be explained below with reference to the embodiment shown in the drawings. FIG. 1 is a diagram showing the configuration of an embodiment of the present invention. Reference numeral 1 designates operating condition detector means for detecting the operating conditions of an engine 6 as an electrical signal, which means 1 includes an accelerator operation amount detector 1*a* and two engine speed detector means 1*b* and 1*b*'. Numeral 2 designates an electric control circuit including target value computing means and driving means for computing a target position of a fuel injection amount regulator member 4 corresponding to a target amount of fuel to be injected into the engine 6 in response to the accelerator operation amount signal and the engine speed signal from the operating condition detector means 1 on the one hand and driving the electromagnetic actuator 3 in such a manner as to correct the error between an actual position of the fuel injection amount regulator member and the target position of the fuel injection amount regulator member in response to an actual position signal corresponding to the actual fuel injection amount detected by the actual position detector 7 and the signal representing the target position of the injection amount regulator member on the other hand. The electromagnetic actuator 3 drives the injection amount regulator member 4 in response to a signal from the electrical control circuit 2. The injection amount regulator member 4 is made up of a control rack and the fuel injection pump 5 of a Bosch straight type fuel injection pump. The actual position detector 7 is for detecting the position of the injection amount regulator member (control rack) which regulates the amount of fuel injected to the engine 6 actually from the fuel injection pump 5, and comprises a position sensor of variable inductance type according to the embodiment under consideration.

Figure 2:
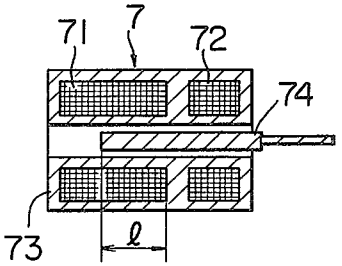
FIG. 2 is a sectional view of the essential parts of an actual position detector included in FIG. 1.
Figure 3:
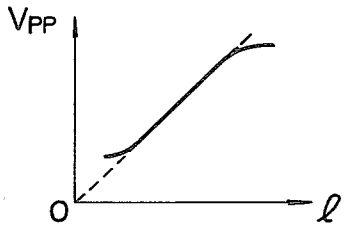
FIG. 3 shows the characteristic of the actual position detector.

The construction of the actual position detector 7 of variable inductance type is shown in FIG. 2. A hollow bobbin 73 is wound with a primary coil 72 and a secondary coil 71. A core 74 is inserted in the hollow portion. Upon application of an exciting signal of predetermined amplitude and predetermined frequency to the primary coil 72, a voltage is generated across a resistor at the terminal of the secondary coil 71. Assume that the core 74 inserted into the hollow portion is superimposed on the secondary coil 71 over the length of l. The relation between the voltage Vpp generated across the secondary coil 71 and the length l is as shown in FIG. 3. The actual position detector according to this embodiment utilizes the substantially straight portion of this characteristic.

Figure 4:
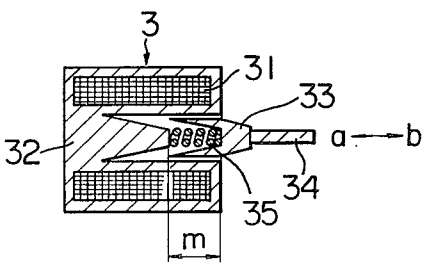
FIG. 4 is a sectional view of the essential parts of an electromagnetic actuator.
Figure 5:
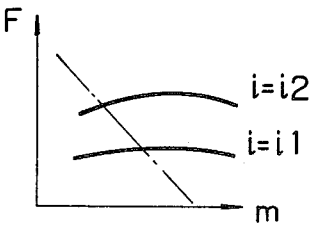
FIG. 5 is a diagram showing the characteristic of the electromagnetic actuator.

A construction of the electromagnetic actuator (linear solenoid type) 3 is shown in FIG. 4. The electromagnetic actuator 3 includes a coil 31, a core 32 for holding the coil 31 to form a magnetic circuit, a moving core 33 providing a moving part, a connecting rod 34 directly coupled with the moving core 33 and a spring 35. The moving core 33 and the connecting rod 34 are movable in two directions of a and b. The moving core 33 is adapted to stop when the force in the direction of arrow a generated by the current 1 flowing in the coil 31 is balanced with the restitution power in the direction of b generated by the spring 35 mounted in the electromagnetic actuator. FIG. 5 shows the relation between the current flowing in the coil 31, the length m of the gap between the core 32 and the moving core 33, and the force F generated along the arrow a by the current. The one-dot chain in FIG. 5 shows the force along the arrow b generated by spring 35. As seen from this diagram, the position of the injection amount regulator member according to this embodiment may be regulated by controlling the current flowing in the coil 31.

Figure 6:
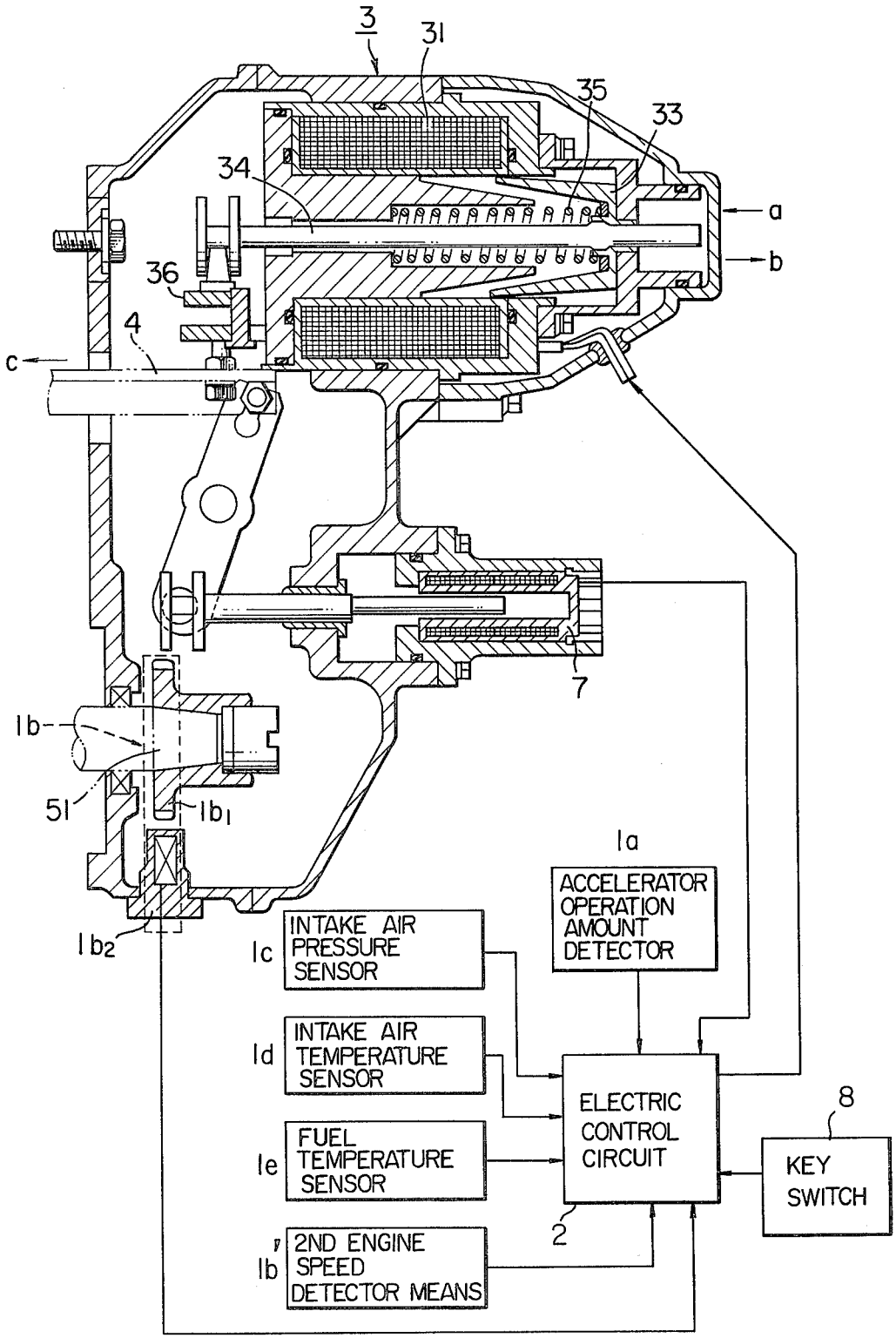
FIG. 6 is a diagram showing a sectional view of the essential parts of the present invention as applied to the Bosch straight type fuel injection pump.

A sectional view of the essential parts of the apparatus according to the present invention as applied to a Bosch straight type fuel injection pump is shown in FIG. 6. The amount of fuel injection may be controlled according to the position of the fuel injection amount regulator member (control rack) 4 protruded from the body of a Bosch straight type fuel injection pump not shown.

The position of the moving core 33 is determined by the electromagnetic actuator 3 in equilibrium with the force along the arrow b generated by the current flowing in the coil 31. The moving core 33 moves the control rack 4 through the connecting rod 34 and the link mechanism 36 thereby to control the fuel injection amount. Numeral **1*b* designates first engine speed detector means for detecting the speed of the engine, which comprises a gear 1*b*1 directly coupled to the pump drive shaft 51 and an electromagnetic pickup 1*b*2 having a sensor provided in opposition to the tip of the gear 1*b*1 so that an electrical signal from the electromagnetic pickup 1*b*2 is applied to the electric control circuit 2 as an engine speed signal. Numeral 1*b*' designates an alternator making up a second engine speed detector means for applying an electrical signal from a neutral point to the electric control circuit 2 as an engine speed signal. Numeral 1*a* designates an accelerator operation amount detector using a potentiometer for applying an electrical signal associated with the accelerator operation amount to the electric control circuit 2. Numeral 1*c*, 1*d* and 1*e* are sensors of intake pressure, intake air temperature and fuel temperature respectively for applying corresponding electrical signals to the electric control circuit 2 respectively. Numeral 8** designates a key switch for detecting the on or off state of the starter.

In response to detection signals from the engine speed detector means **1*b*, 1*b*', the accelerator operation amount detector 1*a*, the intake air pressure detector 1*c*, the intake air temperature detector 1*d*, the fuel temperature detector 1*e* and the key switch 8, the electric control circuit 2 computes a target position of the control rack 4 corresponding to a target injection amount of the fuel injection pump, compares a signal representing the target position with an actual position signal from the actual position detector 7, applies to the electromagnetic actuator 3 a signal associated with the error between the target position and the actual position, and drives the electromagnetic actuator 3** in a manner to correct the error. According to the embodiment under consideration, the target injection amount and the target position are computed by microcomputer.

Figure 7:
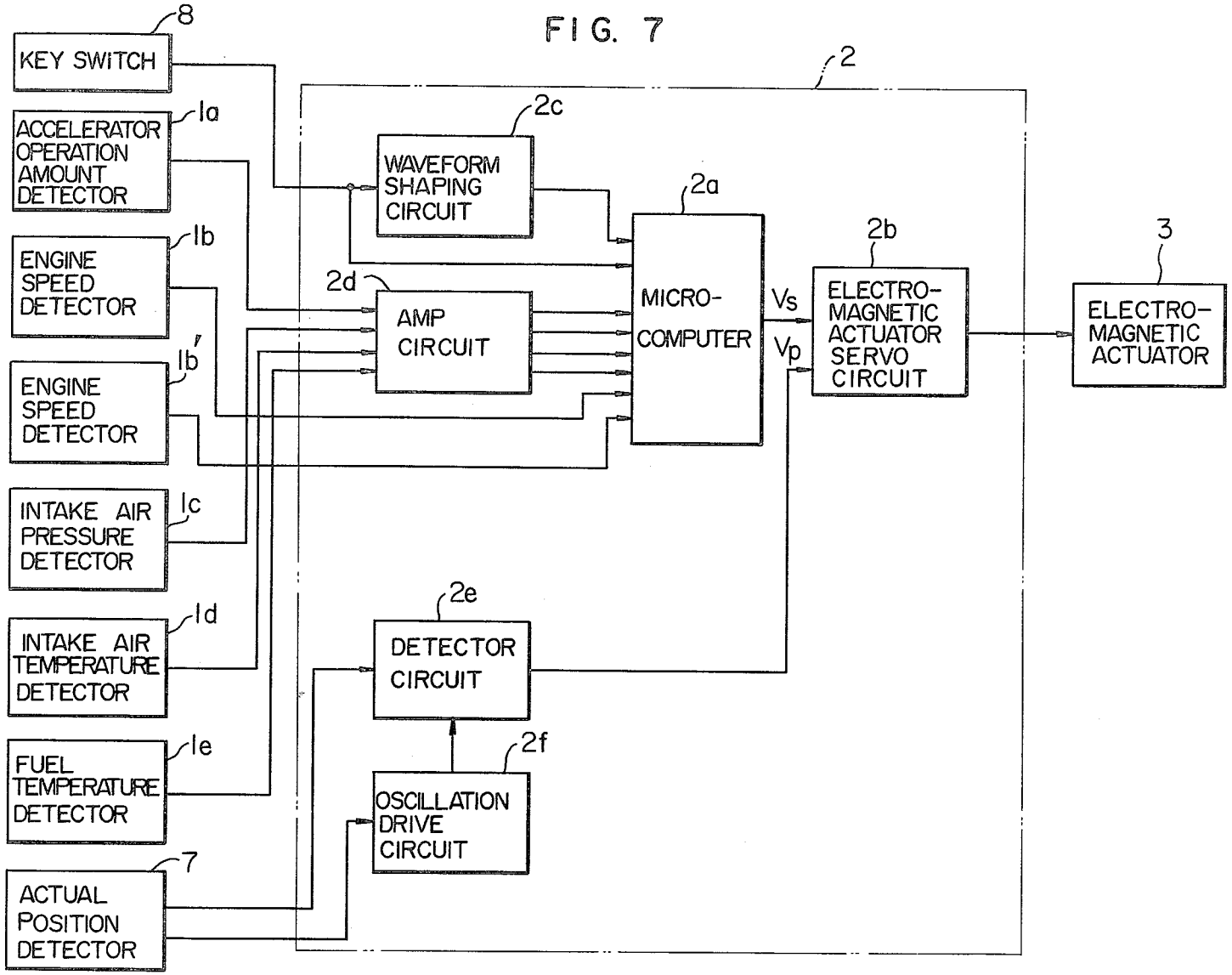
FIG. 7 is a block diagram showing an electric control circuit in FIG. 1.

The configuration of the electric control circuit 2 is shown in FIG. 7. The electric control circuit 2 includes a microcomputer unit **2*a* for computing a target injection amount and a target position of the control rack from the signals from the detectors, an electromagnetic actuator servo circuit 2*b* supplied with the target position signal representing the target position of the control rack computed by the microcomputer unit 2*a* and the actual position signal from the actual position detector 7 for driving the electromagnetic actuator 3 in a manner to correct the error between the two signals, a waveform shaping circuit 2*c*, an amplifier circuit 2*d*, a detector circuit 2*e* and an oscillation drive circuit 2*f***.

Figure 8:
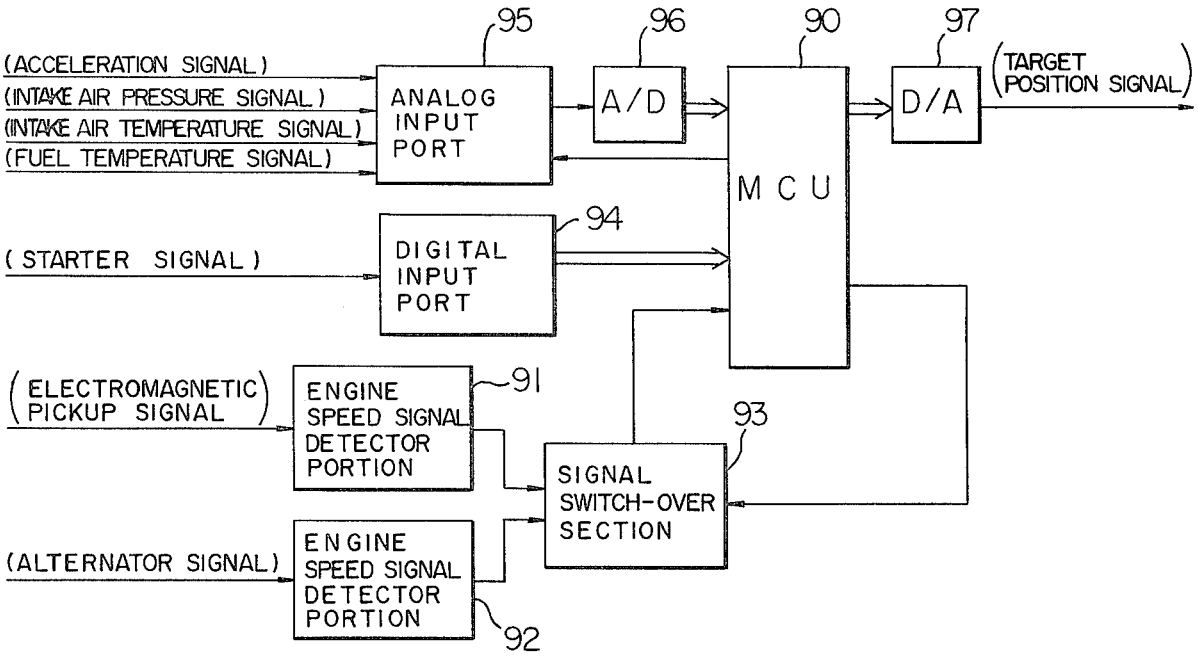
FIG. 8 is a block diagram showing a microcomputer unit in FIG. 7.

FIG. 8 shows a detailed construction of the microcomputer unit **2*a*. Numeral 90 designates a one-chip microcomputer unit (MCU) of 8-bit construction including a central processing unit (CPU) for computing a target injection amount, a read-only memory unit (ROM) storing a control program and control constants, and a random access memory (RAM) used for temporary storage of control data during operation according to the control program. Numerals 91 and 92 designate engine speed signal detector portions for shaping into pulse signals the signals generated from the engine speed detector means 1*b* and 1*b*' respectively. Numeral 93 designates a signal switch-over section for selecting one of the pulse signals from the engine speed detector means 1*b* or 1*b*' in response to a command from the microcomputer unit, so that the intervals of the particular pulse signal is measured by timer in the microcomputer unit thereby to produce a value inversely proportional to the engine speed. A digital input port 94 is used for receipt of a logic signal and is supplied with a shaped signal from the key switch 8 in order to recognize that the starter is driven at the time of engine start. An analog input port 95 is a port used for receipt of an analog signal and is supplied with the acceleration signal, the intake air pressure signal, the intake air temperature signal and the fuel temperature signal thereby to select one of them at a multiplexer. Numeral 96 designates an A/D converter for accomplishing an analog-digital conversion of a signal applied thereto through the analog input port 95. Numeral 97 designates a digital-analog converter for converting the target position signal produced in the form of digital signal from the microcomputer unit 90** into an analog signal.

Figure 9:
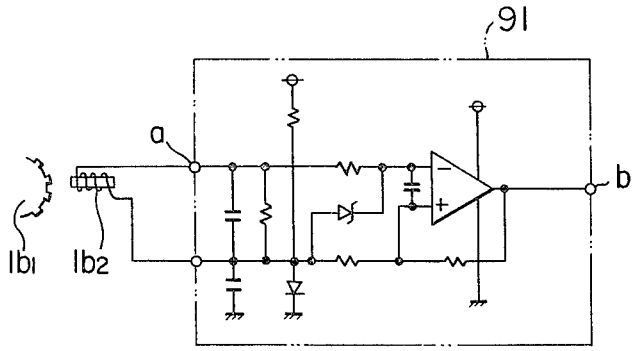
FIGS. 9 and 10 are electrical circuit diagrams of an engine speed signal detector section in FIG. 8.
Figure 10:
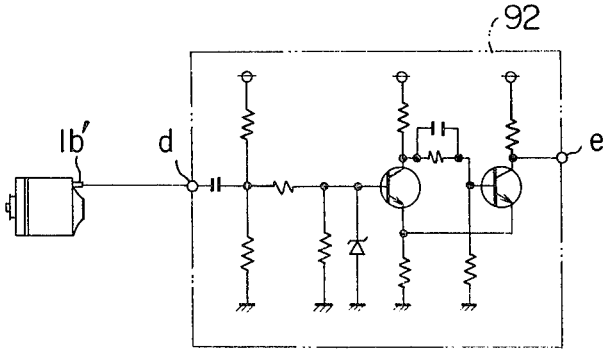
Figure 11:
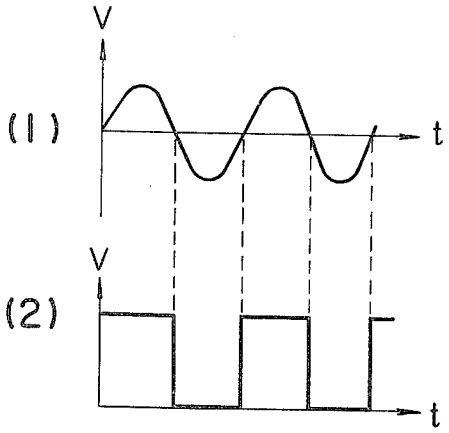
FIG. 11 is a diagram showing input and output signal waveforms in FIGS. 9 and 10.

Detailed constructions of the engine speed signal detector portions 91 and 92 are shown in FIGS. 9 and 10 respectively. Signal waveforms of the input and output of the circuits of FIGS. 9 and 10 are shown in FIG. 11. The signals at points a and d making up an output signal of the electromagnetic pickup 1b2 or the output signal at the neutral point of the alternator 1b' take the waveform as shown in FIG. 11(1). The output is produced in rectangular form (waveforms at points b and e) as shown in FIG. 11(2).

Figure 12:
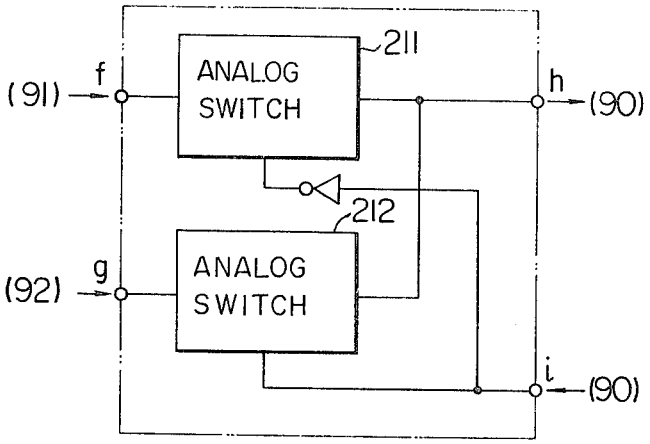
FIG. 12 is an electrical circuit diagram of a signal switching section in FIG. 8.

A detailed construction of the signal switchover section 93 is shown in FIG. 12. The input terminal f is impressed with a signal from the engine speed signal detector portion 91, and terminal g is supplied with a signal from engine speed signal detector portion 92. The input terminal i is supplied with an engine speed signal selection signal from the microcomputer unit 90. Numerals 211 and 212 designate analog switches capable of cutting off the circuit as desired. When the input signal at point i is at low level, the signal of the input terminal f is produced at the output terminal h, while when the input signal at point i is at high level, the signal of the terminal g is produced at the terminal h. The computer is thus capable of selecting one of the input signals by manipulating the signal at point i.

Figure 13:
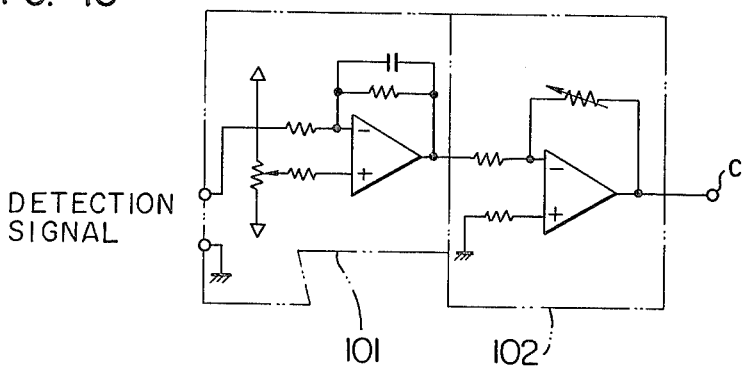
FIG. 13 is an electrical circuit diagram of an amplifier circuit in FIG. 7.

FIG. 13 shows an amplifier circuit 2d for amplifying the signals from the accelerator operation amount detector 1a, the intake air pressure detector 1c, the intake air temperature detector 1d and the fuel temperature detector 1c and converting the same signal into a signal voltage easily handled by the microcomputer unit 2a. Numeral 101 designates a circuit for moving up or down the level of the signal produced from the detectors, and numeral 102 an amplifier section capable of setting the circuit gain freely. It is possible by this amplifier circuit to determine a signal voltage corresponding to each detection value as desired. The output signal at the terminal C is applied to the analog input port 95.

Figure 14:
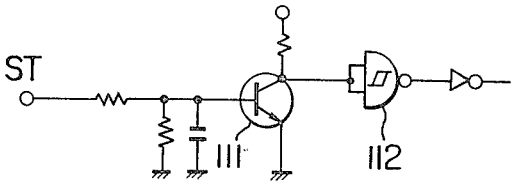
FIG. 14 is an electrical circuit diagram of a waveform shaping circuit in FIG. 7.

The diagram of FIG. 14 shows a waveform shaping circuit 2c for processing the starter signal ST from the key switch and applying it to the digital input port 94. Numeral 111 designates a transistor for converting the level of the signal from the key switch, and numeral 112 a Schmidt trigger circuit for waveform-shaping the pulse signal.

Figure 15:
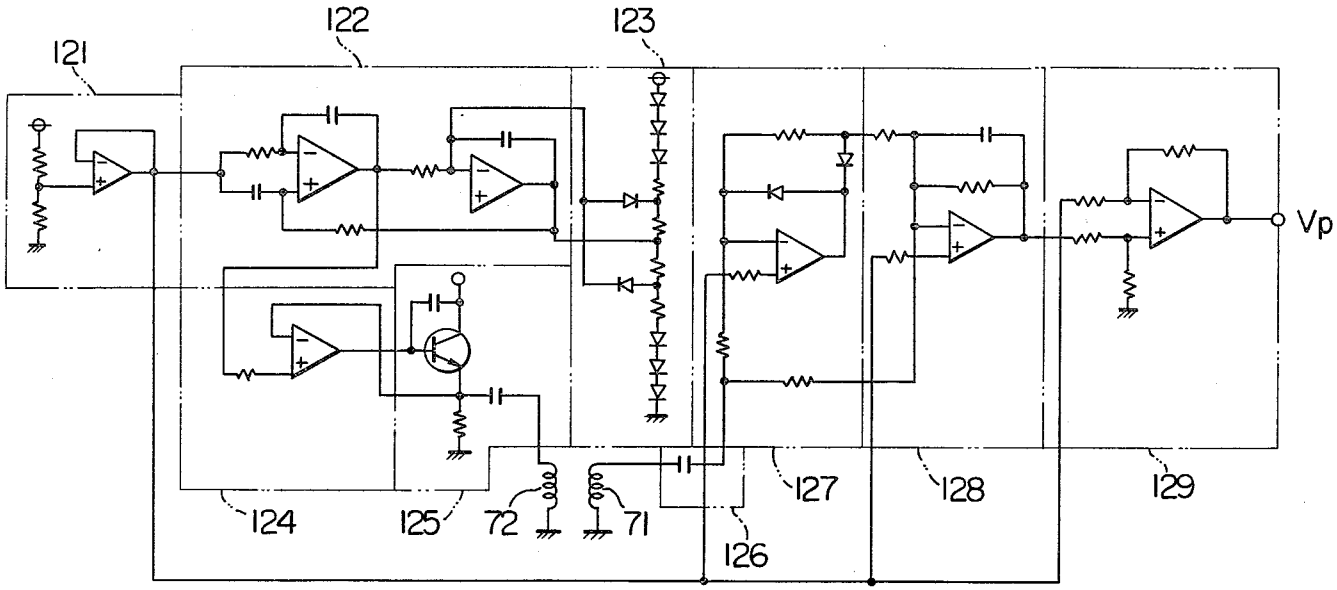
FIG. 15 is an electrical circuit diagram of a detector circuit and an oscillation drive circuit in FIG. 7.

FIG. 15 shows circuits related to the actual position detector 7, namely, a detector circuit 2e and an oscillation drive circuit 2f. In this figure, numerals 121 to 125 designate the oscillation drive circuit, and numerals 126 to 129 make up the detector circuit. Numeral 121 designates a constant-voltage circuit for supplying a predetermined offset voltage to each amplification stage, which circuit includes a voltage-dividing resistor circuit and a buffer amplifier circuit. Numerals 122 and 123 designate quadrature oscillation circuits, and numeral 124 a buffer amplifier circuit, and numeral 125 a current amplifier. Numeral 122 designates an oscillation section of the quadrature oscillation circuit, and numeral 123 an amplitude control circuit for limiting the amplitude of the oscillation waveform of the oscillator. The detector circuit includes a capacitor 126 for cutting off the DC portion, a full-wave rectifier circuit 127, an integrator circuit 128 and a differential amplifier circuit 129. The output signal $V_p$ of the differential amplifier circuit 129 is applied as an actual position signal to the electromagnetic actuator servo circuit 2b.

Figure 16:
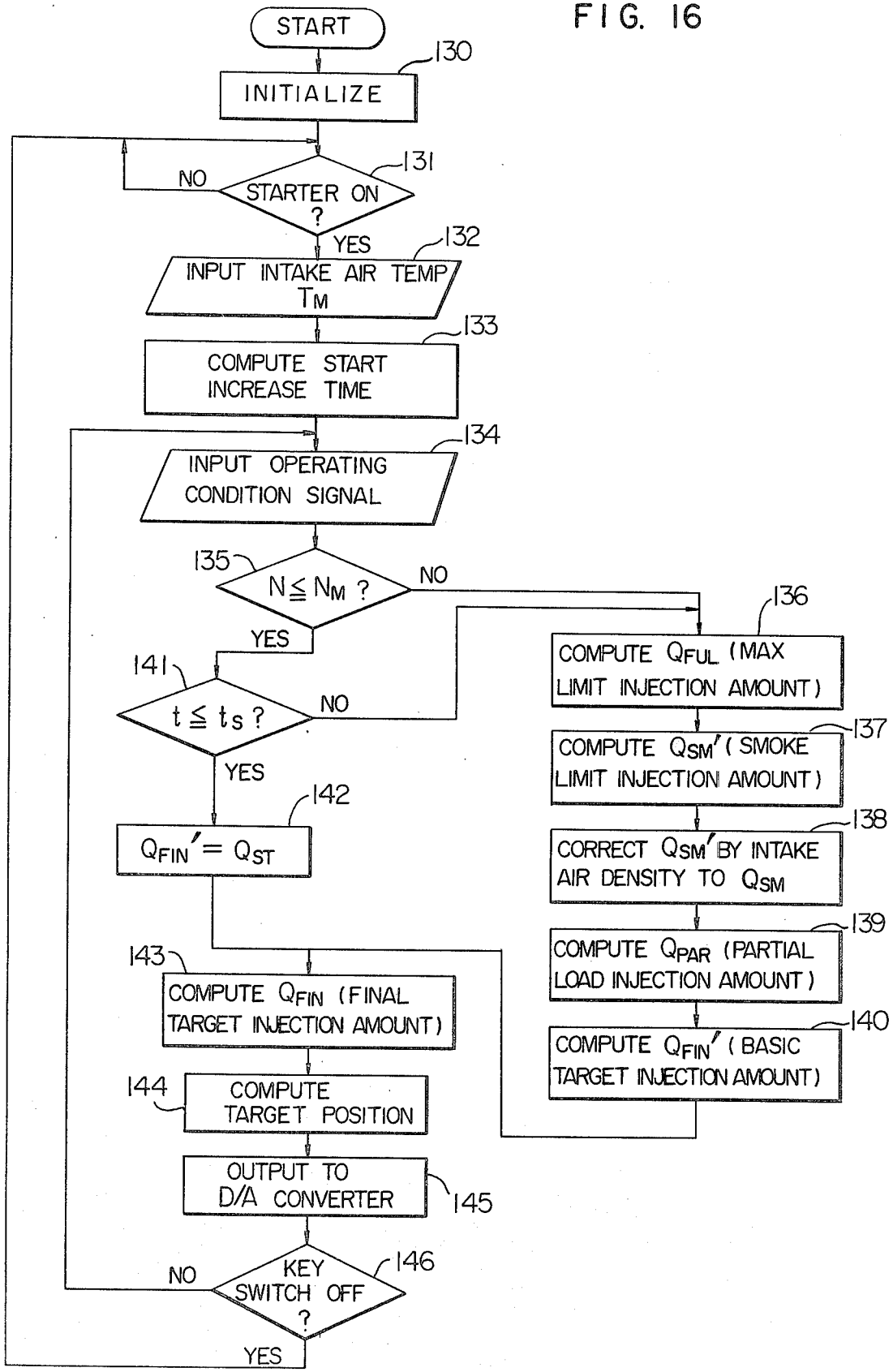
FIGS. 16, 17, 20, 23, and 24 are flowcharts showing the processing steps in the microcomputer section of FIG. 8.
Figure 17:
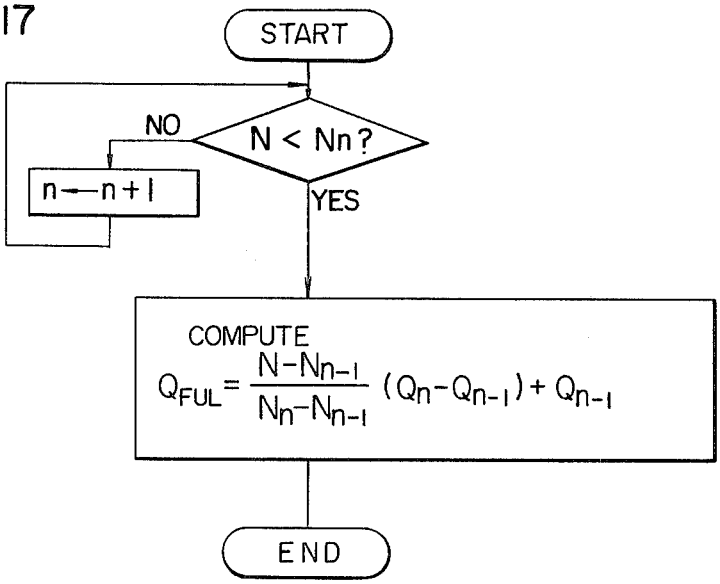
Figure 18:
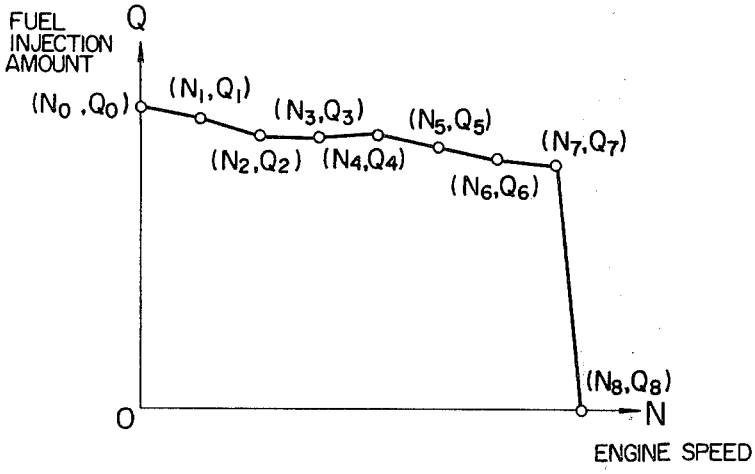
FIGS. 18, 19, 21, 26 and 27 show characteristics for explaining the operation of the present invention.

A flowchart representing the processing steps in the microcomputer unit 2a is shown in FIG. 16. The steps of computing the target position signal representing a target position of the control rack 4 making up a fuel regulation member will be explained with reference to this flowchart. Numeral 130 designates a program initialize step for making various preparations necessary for the processing, including the setting of conditions for the input-output ports and reducing the data in the variables storage area to zero. Numeral 131 designates a step for deciding whether or not the starter signal is turned on, and when the key switch of the vehicle is turned to starter-on position, the process proceeds to step 132. In the description that follows, the engine speed is denoted by N, the accelerator operation amount by $R_A$, the intake air temperature by $T_M$, the fuel temperature by $T_F$ and the intake air pressure by $P_M$. Numeral 132 designates a step for fetching the signal from the intake air temperature detector 1d at the time of engine start into the microcomputer unit. Numeral 133 designates a step for computing the start fuel increasing time ts. The start fuel increasing time ts is a function of the intake air temperature $T_S$ at the time of engine start and is set to facilitate the starting of the engine. Numeral 134 designates a step for fetching the signal from the operating conditions detector means 1 into the microcomputer unit. Numeral 135 designates a step for deciding whether or not the current engine speed belongs to a region ($N \leqq N_M$) where the addition of the start increase pattern is required. If the particular region is involved, the process proceeds to step 141 for deciding whether or not the present time is included in the start fuel increasing time ($t \leqq ts$). If it is in the start fuel increasing time, the process proceeds to step 142 where the basic target injection amount $Q_{FIN}'$ is set to the start injection amount $Q_{ST}$. If N is larger than $N_M$ at step 135 or t is larger than ts at step 141, the process proceeds to step 136 for computing the maximum limit injection amount $Q_{FUL}$. A detailed flowchart of this process is shown in FIG. 17, and a pattern of the maximum limit injection amount is shown in FIG. 18. This pattern is defined by arranging $N_0$, $Q_0$, $N_1$, $Q_1$, . . . , $N_n$, $Q_n$ in that order in the read-only memory of the microcomputer unit 90 of the microcomputer 2a. The value n is not fixed but variable, so that a given pattern of the maximum limit injection amount $Q_{FUL}$ is realizable. By increasing the value n, it is possible to perform a more detailed control thereby to produce a desired output. The step 136 computes the maximum limit injection amount $Q_{FUL}$ from the pattern of FIG. 18 by use of the engine speed N along as well as by use of the signal representing the operating conditions. As an example, if N is an engine speed between $N_3$ and $N_4$, the injection amount $Q_{FUL}$ *is given as*

$$Q_{FUL}=(N-N_3)/(N_4-N_3)\times(Q_4-Q_3)+Q_3$$

Figure 19:
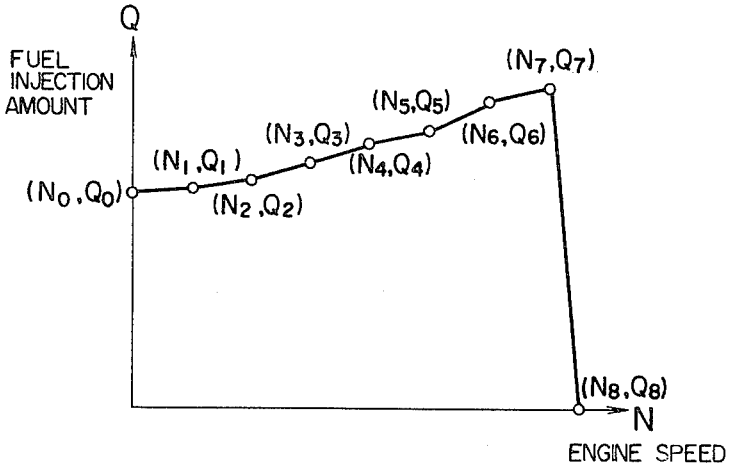

Step 137 is for computing the smoke limit injection amount $Q_{SM}'$ in the same manner as the value $Q_{FUL}$. A pattern of the smoke limit injection amount is shown in FIG. 19.

Step 138 is one for correcting the smoke limit injection amount $Q_{SM}'$ determined at step 137 by the intake air density (a function of $P_M$ and $T_M$), the corrected smoke limit injection amount being $Q_{SM}$. Generally, with the increase in the air intake amount, the smoke limit injection amount increases.

Figure 20:
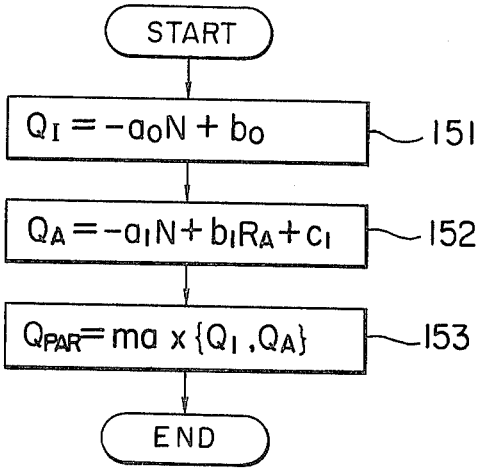
Figure 21:
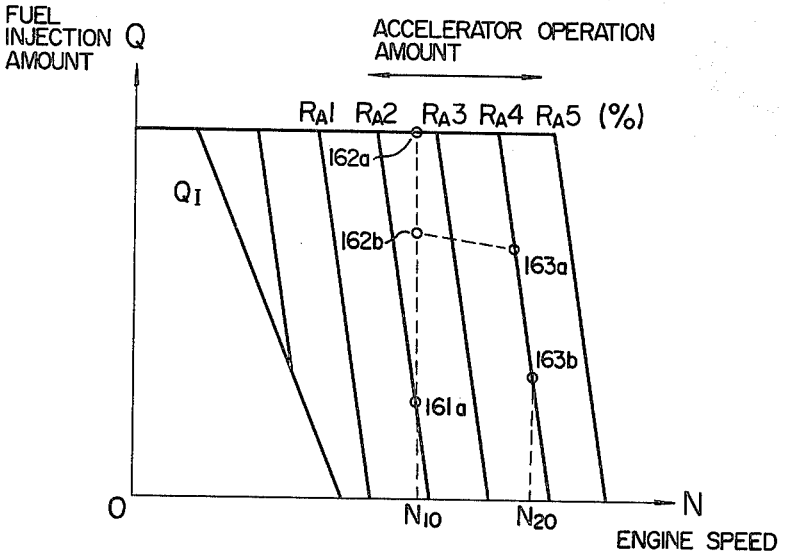

The step 139 is for computing the fuel injection amount under partial load by use of the engine speed N and the accelerator operation amount $R_A$. A detailed flowchart of the step 139 is shown in FIG. 20, and a fuel injection amount pattern under partial load of fuel injection amount is shown in FIG. 21. At step 151 of FIG. 20, the idle injection pattern QI is computed as $QI=-aoN+bo$ (ao, bo: constants). Then, at step 152, the injection pattern QA corresponding to the accelerator operation amount $R_A$ is computed as $QA=-alN+blR_A+cl$ (al, bl, cl: constants), and at step 153, the larger one of QI and QA is determined as the partial load injection amount $Q_{PAR}$. By these computations, the pattern of partial load injection amount as shown in FIG. 21 is obtained.

The step 140 is for computing the basic target injection amount $Q_{FIN}'$ from $Q_{FUL}$ obtained at step 136, $Q_{SM}$ corrected by intake air density as obtained at step 138, and $Q_{PAR}$ obtained at step 139. The values $Q_{FUL}$, $Q_{SM}$ corrected by intake air density and $Q_{PAR}$ are compared with each other, and the smallest one is determined as $Q_{FIN}'$, as expressed by the equation below.

$$Q_{FIN}'=Min\{Q_{FUL}, Q_{sm}Q_{PAR}\}$$

The step 143 is for correcting the basic target injection amount $Q_{FIN}'$ computed at step 140 or 142 by the fuel temperature $T_F$. Since the basic target injection amount $Q_{FIN}'$ is determined by the volume of fuel at standard temperature, the final target injection amount $Q_{FIN}$ (volume) is obtained by correcting the amount $Q_{FIN}'$ by fuel temperature in order to inject the fuel of the same mass as at the standard temperature.

Figure 22:
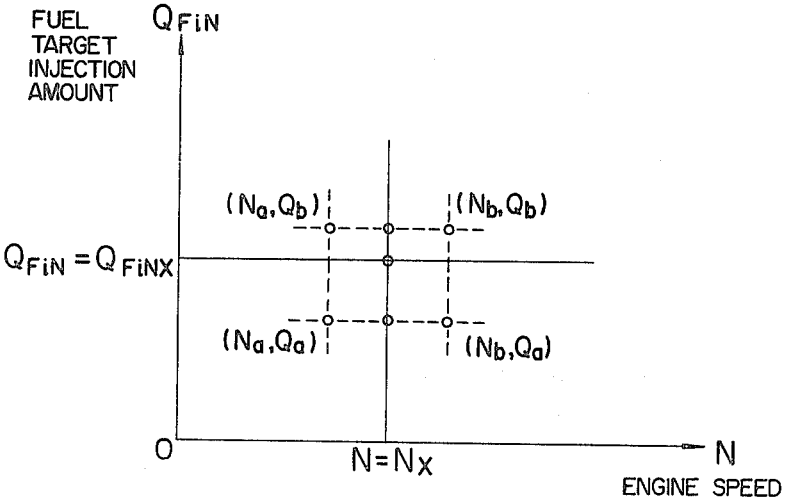
FIG. 22 is a diagram showing a map for computing a target injection amount.

The step 144 is for computing the target position of the control rack 4 from the final target injection amount $Q_{FIN}$ computed through the steps 135 to 143. In the case of the straight type fuel injection pump, the amount of injection changes with the rotational speed of the injection pump even when the position of the control rack 4 remains unchanged. At step 144, the characteristics of the injection pump are corrected and the target position of the control rack 4 is computed to attain the same injection amount as the final target injection amount $Q_{FIN}$ regardless of the rotational speed of the injection pump. The values of the target position signal $V_{SN}$ indicative of the target position of the control rack 4 in relation to the engine speed N and the final target injection amount $Q_{FIN}$ are stored in the read-only memory in the microcomputer unit 90 of the microcomputer 2a as a map. Explanation will be made about an example of steps of determining the target position signal $V_{SN}$ from a value of this map. Assume that the engine speed $N=Nx$, the final target injection amount computed at step 143 is $Q_{FIN}=Q_{FINx}$ and these values have the relation $Na<Nx<Nb$ and $Qa<Q_{FINx}<Qb$. Also assume that the target position signal at point (Na, Qa) is $V_{SN}=V_{SN1}$, the target position signal at point (Nb, Qa) is $V_{SN}=V_{SN2}$, the target position signal at point (Na, Qb) is $V_{SN}=V_{SN3}$, and the target position signal at point (Nb, Qb) is $V_{SN}=V_{SN4}$. The process of determining the target position signal $V_{SNx}$ at point (Nx, $Q_{FINx}$) under this condition will be explained with reference to FIG. 22. First, the target position signal $V_{SNa}$ at point (Nx, Qa) will be determined by the equation below.

$$V_{SNa}=(Nx-Na)/(Nb-Na)\times(V_{SN2}-V_{SN1})+V_{SN1}$$

Now, the target position signal $V_{SNb}$ at point (Nx, Qb) is determined from the equation below.

$$V_{SNb}=(Nx-Na)/(Nb-Na)\times(V_{SN4}-V_{SN3})+V_{SN3}$$

Finally, the target position signal $V_{SN}$ at point (Nx, $Q_{FINx}$) is determined from the equation below.

$$V_{SN}=(Q_{FINx}-Qa)/(Qb-Qa)\times(V_{SNb}-V_{SNa})+V_{SNa}$$

The computation shown by these series of computation formulae are performed at step 144.

The step 145 is for applying the result of computation $V_{SN}$ obtained at the step 144 to the digital-analog converter. The digital-analog converter generates an analog target position signal Vs proportional to the target position signal $V_{SN}$. Numeral 146 designates a step deciding whether or not the driver has turned off the key switch on the basis of whether the battery voltage is higher or lower than a predetermined voltage level. This is possible since the battery voltage is applied to the microcomputer 2a through the key switch. In the case where step 146 decides that the key switch is off, the process is returned to step 131, which is executed until the driver turns the key switch to starter-on position as a stand-by state. If it is decided that the key switch is not off, the process proceeds to step 134 for computing the next injection amount in response to a new operating condition signal.

Figure 23:
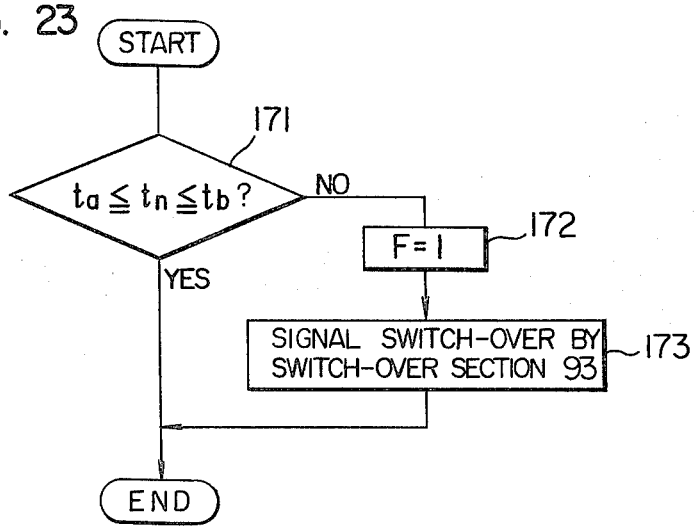

FIG. 23 is an interruption routine flowchart showing the processing steps for detection of an engine speed signal abnormality. The step 171 is for deciding whether or not the signal from the first engine speed detector means 1b satisfies predetermined conditions, where tn is the difference between the present time To and the latest rise point Tn of the rectangular wave obtained from the electromagnetic pickup 1b2 through the engine speed signal detector portion 91. That is, $tn=To-Tn$. ta and tb are predetermined time, and tb is larger than ta. If the signal fails to be applied to the electric control circuit 2 for some abnormality of the first engine speed detector means 1b, tn is larger than tb, followed by transfer to step 172 for raising the flag F to 1 for recognizing the abnormality of the engine speed detector means. At step 173, the signal switching section 93 of the microcomputer 2a is switched thereby to apply a signal to the microcomputer unit 90 through the engine speed signal detector portion 92 from the alternator 1b' making up the second engine speed detector means.

Figure 24:
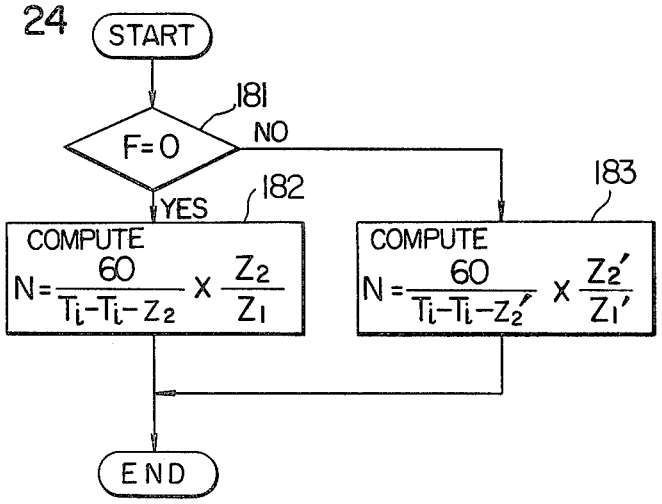

A flowchart of interruption routine representing the processing steps for computing the engine speed is shown in FIG. 24. Each time of application of a rectangular signal to the microcomputer unit 90 of the microcomputer 2a for detection of the engine speed through the signal switch-over section 93, the interruption process is taken to compute the engine speed N. At step 181, it is decided whether or not the first engine speed detector means 1b is normal from the data of the flag F, and if it is normal, the process proceeds to step 182, while if it is not normal, the process proceeds to step 183. At steps 182 and 183, N is the engine speed (rpm), Z1 and Z1' the number of rectangular waves for each revolution of the engine obtained from the engine speed detector means 1*b* and 1*b*' respectively, Z2 and Z2' are the number of rectangular waves by use of which the engine speed is computed from the engine speed detector means 1*b* and 1*b*' respectively, Tn (n=i, i−Z2, i−Z2') is the rise time (sec) of the n-th rectangular wave obtained through the signal switch-over section 93 of the microcomputer 2*a*, Ti being the rise time of the latest rectangular wave. Z1 is determined from the number of teeth of the gear 1*b*1, and Z1' by the number of phases and poles of the alternator. These are the detail of the program executed by the microcomputer 2*a*.

Figure 25:
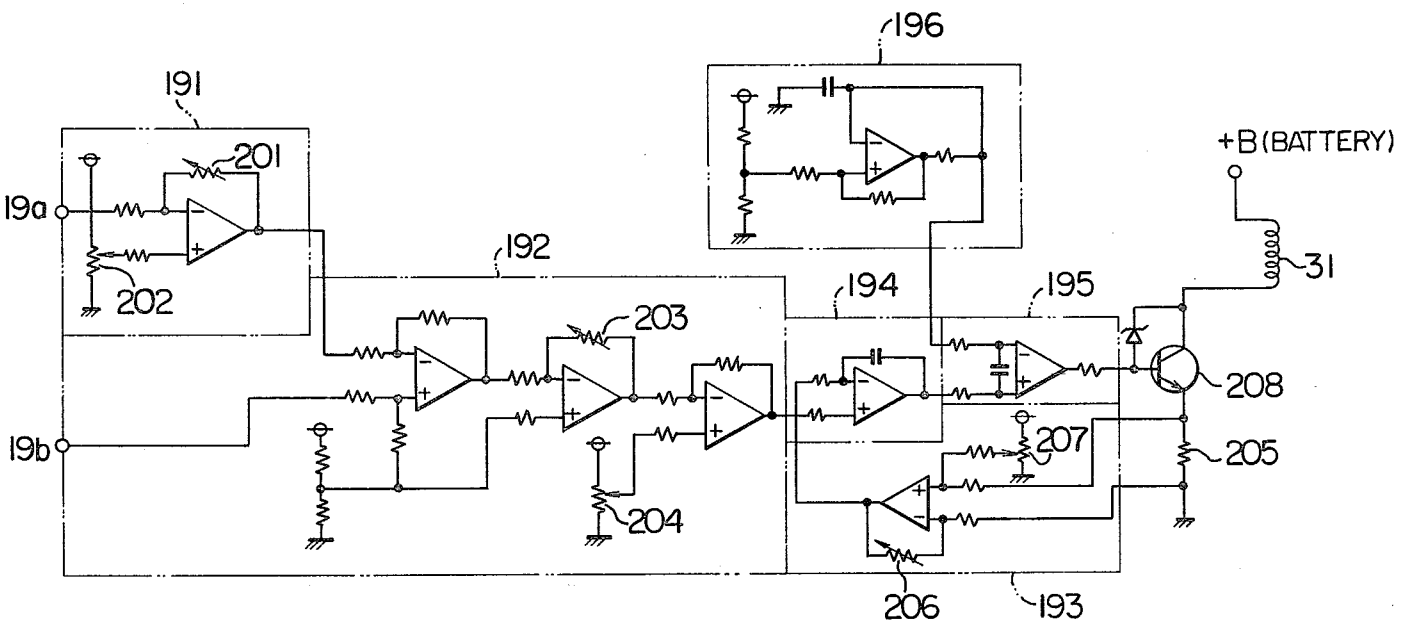
FIG. 25 is an electrical circuit diagram of an electromagnetic actuator servo circuit in FIG. 7.

The electromagnetic actuator servo circuit 2*b* is for driving the electromagnetic actuator 3 in such a manner as to correct the error of the target position with respect to the actual position from the target position signal Vs representing the target position produced from the microcomputer section 2*a* and the signal Vp produced from the actual position detector 7. FIG. 25 shows a detailed electric circuit of the electro-magnetic actuator servo circuit. The target position signal Vs produced from the microcomputer 2*a* is applied to the terminal 19*a*. The output voltage of the reversal amplifier stage takes the form of $-K_1 \times Vs + Vb1$, where $K_1$ is a gain adjustable by the variable resistor 201, and Vb1 is an offset voltage adjustable by the variable resistor 202. The actual position signal Vp is applied to the terminal 19*b*. The amplifier stage 192 is for amplifying the difference between the output voltage of the amplifier stage 191 and the actual position signal Vp applied to the terminal 19*b*, the gain thereof being variable by the variable resistor 203. The output voltage V192 of the amplifier stage 192 is given as $V192 = K2 \times (K_1 Vs + Vp - Vb1) + Vb2$ where $K_2$ is the gain and Vb2 is the offset voltage adjustable by the variable resistor 204. Numeral 205 designates a resistor for detecting the value of the current flowing through the coil 31 of the electromagnetic actuator 3. A voltage proportonal to the current is generated across the resistor 205. The voltage thus generated across the resistor 205 is amplified by the amplifier stage 193, the gain and offset voltage of which are determined by the variable resistor 206 and the variable resistor 207 respectively. The comparator-integrator stage 194 is for comparing and integrating the output voltages of the amplifier stages 192 and 193 so that the current flowing in the coil of the electromagnetic actuator may be finally proportional to the voltage on the average. The comparator state 195 is for comparing the output of the comparator-integrator stage 194 with the output of the oscillator stage 196 thereby to drive the transistor 208 by duty factor control.

Figure 26:
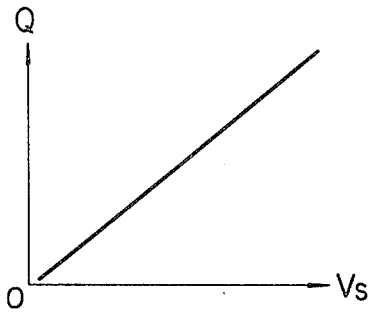
Figure 27:
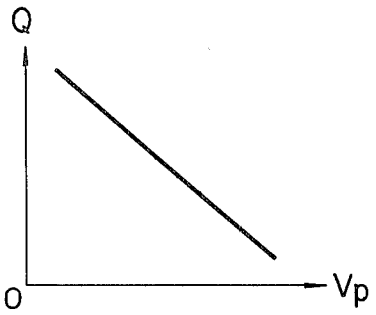

The relation between the injection amount Q and the target position signal Vs is shown in FIG. 26, and the relation between the injection amount Q and the actual position signal Vp in FIG. 27. Due to the relations shown in these drawings, a negative feedback is formed for the injection amount. The relation between the actual position signal Vp and the injection amount Q is shown in FIG. 27 for preventing the over revolutions of the engine in the event that the sensors fail to produce an output signal because of disconnection or the like. The current flowing in the coil 31 of the electromagnetic actuator 3 is converted into a voltage and fed back through the current detecting resistor 205, and the amplifier stage 193 is for dual purposes of compensating for the variations of the battery voltage directly supplied to the coil 31 of the actuator 3 and compensating for the variations of the resistance value of the coil 31 caused by the change of the thermal environment or self heating.

Now, the operation of the fuel injection pump governor comprising the above-mentioned component elements will be explained. Assume that the accelerator operation amount is constant, the intake air pressure, the intake air temperature and fuel temperature are constant, the engine speed is Ne ($Ne > N_M$) and that a normal signal is produced from the first engine speed detector means 1*b*. If the engine speed is reduced below Ne with the change of the load on the engine, the frequency of the waveform detected by the electromagnetic pickup 1*b*2 is reduced thereby to widen the pulses generated from the waveform shaping circuit of FIG. 9. On the basis of this data obtained through the signal switch-over section 93, the microcomputer unit 90 of the microcomputer 2*a* executes the steps 136 to 140 in FIG. 16. With the decrease in the engine speed, the injection amount increases in the computation of the partial load injection amount pattern of FIG. 20 as explained with the computation of step 139. The target signal $V_{SN}$ which is the result of computation of the microcomputer 2*a* thus increases. The signal $V_{SN}$ is converted into an analog target position signal by the step 145, whereby the value Vs increases. At the electromagnetic actuator servo circuit 2*b*, with the increase of the target position signal Vs, the output voltage of the amplifier stage 191 decreases while the output voltage of the amplifier stage 192 increases. With the increase of the output voltage of the amplifier stage 192, the output voltage of the comparator-integrator stage 194 increases. As a result, the conduction time of the transistor 208 increases, and the current in the coil 31 of the electromagnetic actuator 3 increases on the average thereby to generate a voltage across the resistor 205. This voltage is amplified at the amplifier stage 193 and applied to an input terminal of the operational amplifier of the comparator-integrator stage 194. With the increase of the current through the electromagnetic actuator 3, the moving core 33 of the actuator 3 is urged along the arrow a in FIG. 6. With the movement of the moving core 33 in the direction of arrow a, the control rack 4 is driven along the arrow c through an adjacent link mechanism 36. As a result, the fuel injection amount into the engine increases, so that the control rack 4 is held at a position where the engine output and the load are balanced with each other, thus maintaining the engine speed constant.

On the other hand, assume that the driver is driving the vehicle at the accelerator operation amount $R_A$ of 2% as shown in FIG. 21 and that the engine is running at $N_{10}$. If the accelerator operation amount is increased to 4%, the output voltage of the accelerator operation amount detector 1*a* increases thereby to increase the output of the amplifier section 102 of FIG. 13. The microcomputer section 2*q* detects the change of the accelerator operation amount so that the increase of the accelerator operation amount in the computation of steps 136 to 140 causes the partial load injection amount $Q_{PAR}$ to move from point 161*a* to 162*a*. If the smaller one of the values $Q_{FUL}$ and $Q_{SM}$ computed at steps 136 and 138 of FIG. 16 coincides with the point 162*b* in FIG. 21, then the point 162*b* is selected as the basic target injection amount $Q_{FIN}'$ at step 140. Thus the target position signal Vs increases, and the electromagnetic actuator moves in the direction of arrow a through the electromagnetic actuator servo circuit, so that the control rack 4 moves in the direction of arrow c thereby to increase the fuel injection amount. With the increase of the fuel injection amount, the engine speed increases, whereby the smaller one of the values $Q_{FUL}$ and $Q_{SM}$ computed by the microcomputer 2*a* is moved toward the point 163*a* from the point 162*b*, followed by the decline of the injection amount along the partial load injection amount line from point 163*a* to point 163*b*, settling at a new engine speed $N_{20}$.

In the case where the intake air temperature or intake air pressure changes, the smoke limit injection amount $Q_{SM}$ computed at step 138 of FIG. 16 also changes. In the case of normal revolutions under partial load, $Q_{FIN}'=Q_{PAR}$ at step 140, and therefore the engine speed is not affected. In the case where the fuel temperature changes, on the other hand, the value $Q_{FIN}$ computed at the step 143 of FIG. 16 changes in order to maintain constant the mass of the fuel injected at the same engine speed and the same accelerator operation amount.

Further, assume that the period of the rectangular wave produced from the first engine speed detector means 1*b* through the engine speed signal detector portion 91 is abnormally lengthened for such a cause as the disconnection of the coil of the electromagnetic pickup 1*b*2, the disconnection of the wire harness connecting the electromagnetic pickup 1*b*2 and the electric control circuit 2 or the ill contact of the connector. The microcomputer unit 90 of the microcomputer section 2*a* decides that the first engine speed detector means 1*b* is abnormal at step 171 of FIG. 23, sets the flag F to 1 for confirming the anbormality of the engine speed detector means at step 172, and switches the signal switchover circuit 93 at step 173 thereby to apply a signal to the microcomputer unit 90 from the alternator 1*b*' making up the second engine speed detector means, which signal takes a rectangular form through the engine speed signal detector portion 92. In this case, the step 181 in FIG. 24 also decides that the first engine speed detector means 1*b* is abnormal, and the process proceeds to step 183 for computing the engine speed N by the method determined according to the number of phases and poles of the alternator. The other operations are exactly the same as those mentioned above, and since the steps shown in FIG. 16 are executed, the engine may be run in a continued manner even if the normal signal fails to be supplied from the first engine speed detector means for some causes or other.

In the aforementioned embodiment, as the second engine speed detector means, the alternator may be replaced with equal effect by any other means of generating a signal changing with the engine speed, such as means of detecting the vibrations of the fuel injection pipe with a vibration detector or a position detector for detecting the lift of the nozzle needle. Further, three or more instead of two engine speed detector means may be provided.

In the aforementioned embodiment, the microcomputer section automatically switches the signal from the first engine speed detector means to the signal from the second engine speed detector means for computation for control of the engine speed. These signals may alternatively be switched manually, in which case upon occurrence of an abnormal condition of the first engine speed detector means, the engine is required to be provisionally stopped for switching to the second engine speed detector means.

Although description in not made of an alarm signal or the like in the aforementioned embodiment, means may be provided to warn the driver of any abnormal condition of the engine speed detector means by turning on a lamp or the like.

In the above-mentioned embodiment, a signal switching section is provided before the microcomputer unit so that one of the signals from the first and second engine speed detector means is selected and only one signal is applied to the microcomputer unit. Instead of this method, both signals from the first and second engine speed detector means may be applied to the microcomputer unit so that one of them is selected by the program in the microcomputer unit.

Further, the microcomputer section provided in the electric control circuit according to the aforementioned embodiment may be replaced with equal effect by an analog circuit, or the actuator servo circuit may be included as a digital servo in the microcomputer section.

Furthermore, the aforementioned embodiment, which uses a straight type fuel injection pump, applies with equal effect to the distribution type fuel injection pump.

It will be understood from the foregoing description that according to the present invention, there is provided an electric governor comprising an electric control circuit for determining a target fuel injection amount in response to a signal changing with the engine speed and a signal associated with other engine operating conditions, and an actuator of electromagnetic type or fluid pressure type controlled by the electric control circuit for driving and holding the injection amount regulator member of the fuel injection pump at a position corresponding to the target injection amount, the electric governor further comprising a plurality of engine speed detector means for producing a signal changing with the engine speed and means for applying a plurality of signals obtained from the engine speed detector means to the electrical control circuit, the electrical control circuit selecting one of the signals of normal one of the engine speed detector means, computing an engine speed from that signal, determining a target injection amount from the value of engine speed thus computed, thus driving the actuator of electromagnetic type or fluid pressure type. In the event that a normal signal fails to be produced from an engine speed detector means for some cause or other, the signal from another engine speed detector means may be used in substitution for the abnormal engine speed detector, thereby making possible the continued operation of the engine. In this way, the running to a passing place or the powered running is possible without suffering from the worst condition of engine over-revolutions or engine stop which otherwise might be caused by the abnormality of an engine speed detector means.

We claim:

1. An electric governor for a fuel injection pump of an internal combustion engine, comprising:

an actuator for regulating the fuel injection amount of said injection pump;

means for detecting operating conditions of the engine and generating signals representative of the operating conditions, said means including at least two engine speed detector means each for generating an engine speed indication signal changing in accordance with the engine speed;

electronic control means for selecting one of said detector means to check whether the selected means is normally operating and to select the speed indication signal of the selected one detector when it is normally operating, otherwise selecting to check another one of said detector means to select the speed indication signal of the same that is normally operating, and determining a target fuel injection amount in accordance with said operating condition indication signal and said selected engine speed indication signal; and means for controlling said actuator in accordance with said determined target fuel injection amount, wherein said electronic control means includes microcomputer means for checking to see at regular time intervals whether said engine speed indication signal is generated in predetermined normal cycles, said microcomputer means generating an abnormality signal if said engine speed indication signal is not generated in the predetermined normal cycles, and signal switching means for connecting one of said engine speed detector means to said microcomputer means, said signal switching means connecting another engine speed detector means to said microcomputer means instead of said one of said engine speed detector means upon generation of said abnormality signal.

2. An electric governor for a fuel injection pump of an internal combustion engine, comprising:

an actuator for regulating the fuel injection amount of said injection pump;

means for detecting operating conditions of the engine and generating signals representative of the operating conditions, said means including at least two engine speed detector means each for generating an engine speed indication signal changing in accordance with the engine speed;

electronic control means for selecting one of said detector means to check whether the selected means is normally operating and to select the speed indication signal of the selected one detector when it is normally operating, otherwise selecting to check another one of said detector means to select the speed indication signal of the same that is normally operating, and determining a target fuel injection amount in accordance with said operating condition indication signal and said selected engine speed indication signal; and means for controlling said actuator in accordance with said determined target fuel injection amount, said electronic control means including microcomputer means for checking whether said engine speed indication signal is normal or abnormal and generating an abnormality signal when said engine speed indication signal is not generated, said control means including signal switching means for connecting one of said engine speed detector means to said microcomputer means, said signal switching means connecting another engine speed detector means to said microcomputer means instead of said one of said engine speed detector means upon generation of said abnormality signal.

3. An electric governor according to claim 1 or 2, wherein said at least two engine speed detector means include an electromagnetic pickup means for detecting the rotation of the drive shaft of said injection pump and an alternator driven by said drive shaft, said electric governor further comprising first waveform shaping means for connecting the output of said electromagnetic pickup to said signal switching means and second waveform shaping means for connecting the output of said alternator to said signal switching means.

4. An electric governor according to claim 1 or 2, wherein said electronic control means includes:

first and second means for determining the value $Q_{FUL}$ indicative of the maximum limit injection amount stored in advance, in accordance with said selected engine speed indication signal, and the value $Q_{SM}$ indicative of the smoke limit injection amount representing the maximum injection amount avoiding the generation of smoke, respectively;

third means for determining the value $Q_{PAR}$ indicative of the partial load injection amount predetermined in accordance with the partial load representing the accelerator operation amount and said selected engine speed indication signal; and fourth means for comparing the values $Q_{FUL}$, $Q_{SM}$ and $Q_{PAR}$ and determining the smallest one of said values as the value $Q_{FIN}'$ indicative of a target injection amount.

5. An electric governor for a fuel injection pump of an internal combustion engine, comprising:

an electric control circuit for determining a target fuel injection amount of a fuel injection pump in response to an engine speed indication signal changing with engine speed and a signal associated with other engine operating conditions, an actuator of a selected one of electromagnetic and fluid pressure types controlled by said electric control circuit for driving and holding a fuel injection amount regulating member of said fuel injection pump at a position corresponding to said target fuel injection amount, a plurality of engine speed detector means for producing a signal changing with said engine speed, said electric control circuit being supplied with a plurality of signals produced from said engine speed detector means, said electric control circuit selecting one of the signals produced from normal ones of said plurality of engine speed detector means thereby to control the fuel injection amount, said electronic control means including microcomputer means for checking to see at regular time intervals whether said engine speed indication signal is generated in predetermined normal cycles, said microcomputer means generating an abnormality signal if said engine speed indication signal is not generated in the predetermined normal cycles, and signal switching means for connecting one of said engine speed detector means to said microcomputer means, said signal switching means connecting another engine speed detector means to said microcomputer means instead of said one of said engine speed detector means upon generation of said abnormality signal.

6. An electric governor according to claim 3, wherein said electronic control means includes:

first and second means for determining the value $Q_{FUL}$ indicative of the maximum limit injection amount stored in advance, in accordance with said selected engine speed indication signal, and the value $Q_{SM}$ indicative of the smoke limit injection amount representing the maximum injection amount avoiding the generation of smoke, respectively;

third means for determining the value $Q_{PAR}$ indicative of the partial load injection amount predetermined in accordance with the partial load representing the accelerator operation amount and said selected engine speed indication signal; and fourth means for comparing the values $Q_{FUL}$, $Q_{SM}$ and $Q_{PAR}$ and determining the smallest one of said values as the value $Q_{FIN}$, indicative of a target injection amount.

* * * * *